US005621389A

United States Patent [19]

Fellows

[11] Patent Number: 5,621,389

[45] Date of Patent: Apr. 15, 1997

[54] APPARATUS FOR DETECTING A FIRE HAVING A LIQUID FILLED SENSOR TUBE AND COMPENSATION FOR CHANGES IN AMBIENT TEMPERATURE

[75] Inventor: Robert A. Fellows, San Ramon, Calif.

[73] Assignee: Whittaker Corp., Concord, Calif.

[21] Appl. No.: 463,973

[22] Filed: Jun. 5, 1995

[51] Int. Cl.[6] ..... G08B 17/00

[52] U.S. Cl. ..... 340/584; 340/587; 340/594; 340/449; 377/320; 377/321; 374/203

[58] Field of Search ..... 326/584, 587, 326/594, 592; 337/319, 320, 321, 331, 332, 333; 346/449; 374/203, 187

[56] References Cited

U.S. PATENT DOCUMENTS

| | | | |
|---|---|---|---|
| 2,216,589 | 10/1940 | Grooms | 337/320 |
| 2,522,248 | 9/1950 | Bair | 337/320 |
| 2,556,519 | 6/1951 | Bowar | 337/320 |
| 2,826,072 | 3/1958 | Kliever | 337/320 |
| 2,837,615 | 6/1958 | Morgan | 337/320 |
| 4,072,933 | 2/1978 | Pun | 337/320 |
| 4,491,821 | 1/1985 | Olson | 337/321 |

*Primary Examiner*—Jeffrey Hofsass
*Assistant Examiner*—Benjamin C. Lee
*Attorney, Agent, or Firm*—Flehr Hohbach Test Albritton & Herbert

[57] ABSTRACT

A fire detection system includes an elongated liquid filled tube with a fluid coupled alarm switch, with a flexible diaphragm which senses a change from the liquid to vapor phase in the presence of an overheat or fire condition to provide an alarm. To prevent false alarms due to normal expansion of the liquid under changing ambient temperature conditions, a compensator is provided which in one form is a pair of mechanically coupled bellow type containers, filled with the same liquid which will expand at the same rate as the fluid under normal ambient temperature conditions but in a fire condition will resist faster expansion thus causing the alarm switch to be actuated. In another embodiment, a bimetallic bellows is utilized to match the liquid expansion but resist greater vapor pressure. Yet in another embodiment the change in liquid flow rate due to a fire condition is sensed to prevent further accommodation to the normal increase in volume of the liquid. This is done by a flexible diaphragm or a floating seal ball.

3 Claims, 2 Drawing Sheets

APPARATUS FOR DETECTING A FIRE HAVING A LIQUID FILLED SENSOR TUBE AND COMPENSATION FOR CHANGES IN AMBIENT TEMPERATURE

The present invention is directed to apparatus for detecting a fire having a liquid filled sensor tube and compensation for changes in ambient temperature.

BACKGROUND OF THE INVENTION

A well known type of fire detection system using a sensor tube is illustrated in Lindberg Pat. No. 3,277,860 which uses a capillary sensor tube in which is encapsulated a pressurized gas which is released when heated. The rise in pressure actuates an electro-mechanical transducer which signals a fire alarm. Another type of fire related system is illustrated in Wacker Pat. No. 868,307 patented Oct. 15, 1907 where an elongated liquid filled sensor tube when heated by the presence of, for example, a nearby fire or rise in temperature operates on a diaphragm to turn on a water valve to extinguish the fire. Here a coiled thermostat is filled with a "confined expandable liquid such as mineral oil . . . " which when heated would actuate the diaphragm.

In the case of the Lindberg type sensor tube, it is relatively costly and may not be able to operate at the lower fire and hot gas temperatures found in some applications. Thus the liquid filled sensor tube in this respect is preferred. However, liquid filled tubes have difficulty with the normal expansion of the liquid under, for example, an increase in ambient temperature so that a false alarm is not caused. A application, Ser. No. 08/119,731 and assigned to the present assignee, in the name of Robert A. Fellows et al, now Pat. No. 5,458,202, does show a liquid filled fire related system but here the increase in pressure actuates a penetrator which releases pressurized fire extinguishant; because of the pressure thresholds involved, this is a relatively simple application of a liquid filled sensor tube where the expansion of the liquid under ambient temperature increase is a second order effect.

OBJECT AND SUMMARY OF THE INVENTION

It is therefore a general object of the invention to provide apparatus for detecting a fire or hot gases having a liquid filled sensor tube and compensation for changes in ambient temperature.

In accordance with the above object there is provided apparatus for detecting a fire comprising a closed elongated sensor tube completely filled with liquid having a predetermined coefficient of expansion and having a vapor pressure which increases in response to an overheat condition which indicates a presence of a fire or hot gases near the sensor tube. Vapor pressure detection means are connected to the sensor tube and the liquid therein and responsive to the increased vapor pressure including a mechanical to electrical transducer for sensing the vapor pressure. The transducer has a predetermined actuation pressure. Means are provided for compensating for ambient temperature changes which cause expansion or contraction of the liquid in the liquid filled sensor tube, such compensating means including means for distinguishing between normal expansion of the liquid due to an increase in ambient temperature and the vapor pressure of the liquid due to sensing a fire or hot gases, such means in the latter condition allowing for positive actuation of the transducer but in the former condition accommodating the normal increase of volume of said liquid without said actuation.

DESCRIPTION OF PREFERRED EMBODIMENTS

Figure 1:
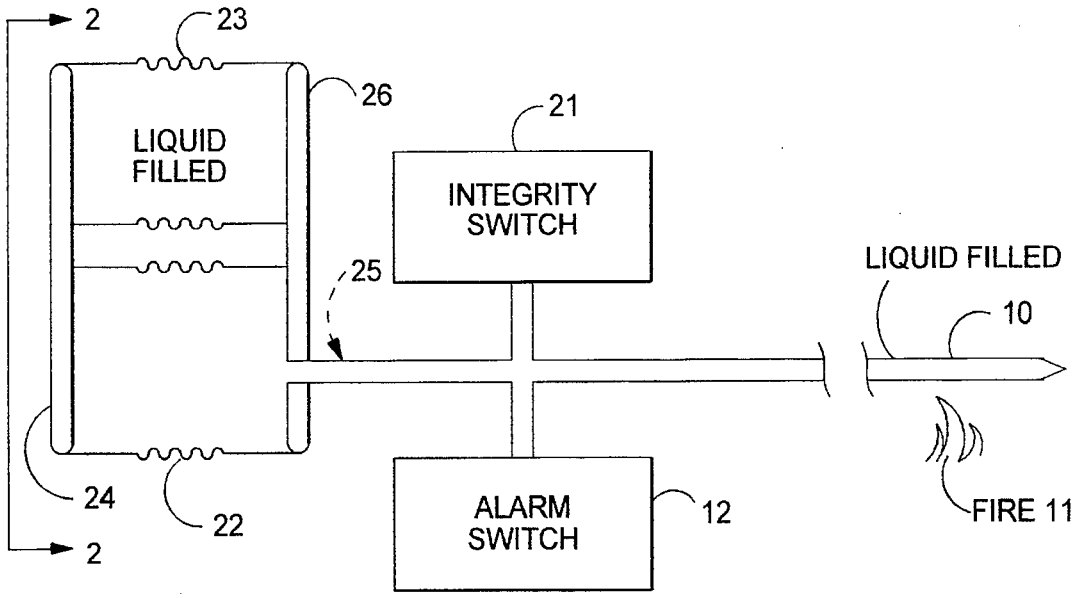
FIG. 1 is a block diagram of apparatus embodying the present invention.

FIG. 1 illustrates one embodiment of the overall fire detection system of the present invention which has as its essential part a liquid filled elongated sensor tube 10 which is completely filled with liquid without gas voids. The tube, for example, might range from 10 to 1000 feet in length. In the presence of a fire 11 (or overheat condition with hot gases) near any portion of the tube, this causes the liquid to change to a vapor phase and the resultant pressure increase actuates an alarm switch 12. Thus it is quite apparent that the tube must be completely liquid filled since if a gas void were present, it would not respond to a significant overheat condition or fire in that portion of the tube 10.

Figure 3:
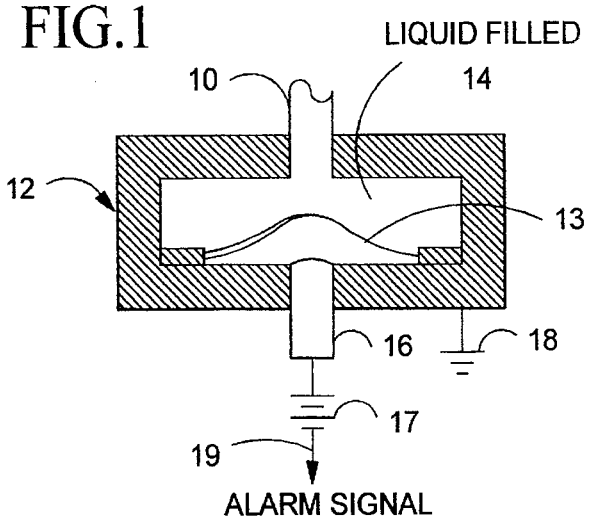
FIG. 3 is a cross-sectional view of one of the switches of FIG. 1.

Alarm switch 12 is illustrated in FIG. 3 and may be of the type having a metal diaphragm 13 with a liquid filled plenum 14 connected to the tube 10. In operation when a fire occurs and the pressure significantly increases due to the change in phase from liquid to the vapor, diaphragm 13 moves against the electrode 16 to complete the circuit between the battery 17 and ground 18 to provide an alarm signal on the line 19. Thus the alarm switch constitutes a mechanical to electrical transducer for sensing vapor pressure which is produced by the presence of a fire or overheat condition near the sensor tube 10.

Similarly an integrity switch 21 is also connected to tube 10 to provide a failsafe indication if the liquid filled tube 10 loses pressure; that is, a hole occurs in the tube 10. Thus the diaphragm 13 of the integrity switch would normally be in contact with the electrode 16 but would release if there was a pressure failure. Such integrity switch is well known in the art as illustrated in, for example, Pat. No. 5,136,278.

Figure 6:
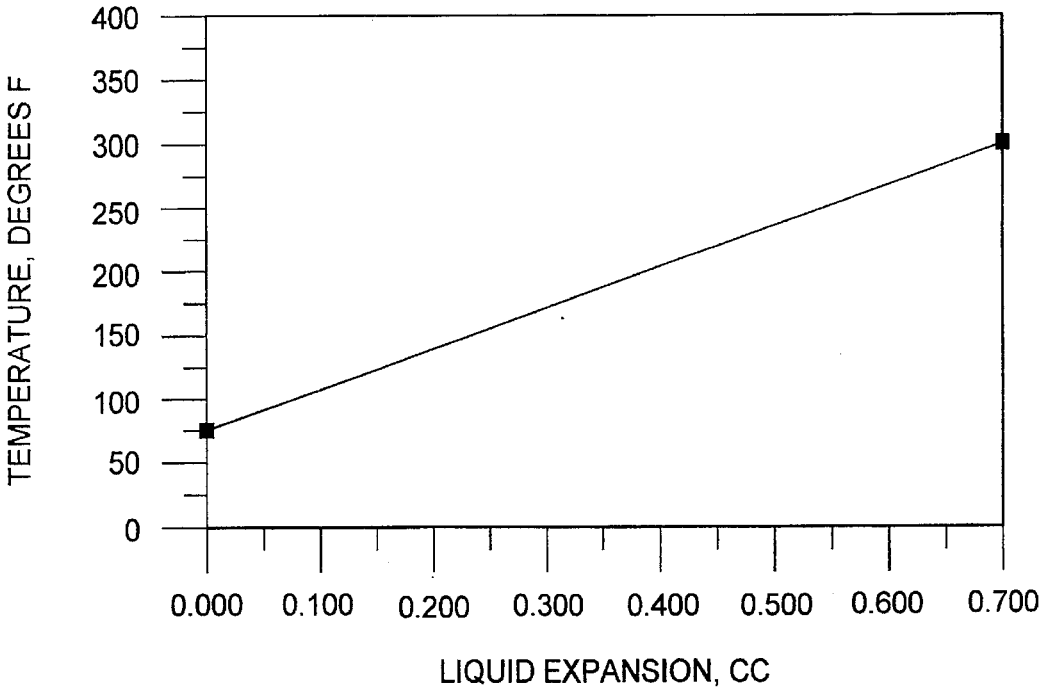
FIG. 6 is a characteristic expansion curve of liquid used in the present invention.

As discussed above, to work effectively, a liquid filled sensor tube cannot have any gas voids. However, this presents another incipient problem in that an increase of ambient operating temperature will, as shown in FIG. 6, cause expansion of the liquid. Thus there must be some kind of compensation to prevent a false actuation of the alarm switch 12. FIG. 6 illustrates a 50/50 mixture of ethylene glycol with water using a tube 0.038 inch in diameter and 35 feet long. The diagram shows an expansion of 0.700 cubic centimeters with a temperature starting at approximately 75° F. going to 300° F. This represents about a 9% fluid expansion 15 over the 225° range. This expansion must be accounted for or a "hydraulic lock" will occur and the pressure in the sensor tube will quickly increase to several hundreds of pounds per square inch which would cause a fire alarm warning just due to ambient temperature excursions. Thus, compensating means are necessary which distinguish between normal expansion of the liquid due to an increase in ambient temperature, as described above, and an increase in pressure due to a change in state from liquid to the vapor phase where the vapor pressure provides for positive actuation of the alarm transducer switch 12; but at the same time the normal increase of volume must be accommodated without such actuation.

FIG. 1 illustrates one technique of doing this where the liquid filled sensor tube 10 is connected to a first bellows type container 22 which, of course, is completely filled with the same liquid. And a second bellows container 23 is also completely filled with the same liquid as in tube 10 and coupled with the first container in parallel by the plates 24 and 26.

Figure 2:
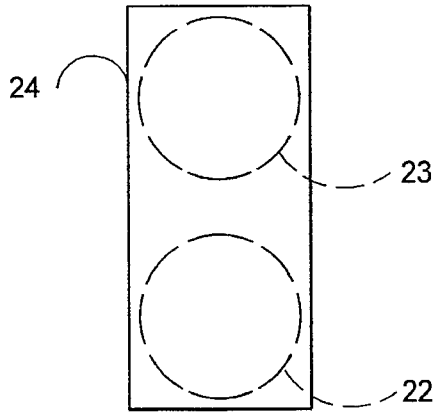
FIG. 2 is a view in elevation taken along the line 2—2 of FIG. 1.

FIG. 2 illustrates the cylindrical bellows in greater detail. The spring rate of the bellows container 22, if this were the only bellows present, would have to be less than the effective actuation pressure of the alarm switch 12 to allow for the expansion of the liquid. However, if this were the case, the alarm switch would never be actuated because when the liquid in tube 10 went into the vapor phase, it would also be accommodated by the bellows 22. Thus, the effective spring rate of bellows 22 should be greater than that of the actuation pressure of alarm switch 12 but still accommodate the liquid expansion. This is provided by the second coupled bellows 23 which is completely filled with the same liquid sealed inside it as in tube 10. This bellows, when heated or cooled, expands or contracts at exactly the same rate as the liquid is expanding in the elongated sensor tube 10. Thus the volume of the bellows container 23 should match that of bellows container 22. Now the bellows 23 will control the spring rate of the bellows 22 so that the effective spring rate is that of bellows 23. Thus bellows 23 will keep or prevent the first bellows container from overexpanding due to a change to vapor phase if an overheat of fire condition is being detected. And this is because the effective spring rate of the combined bellows assemblies 22, 23 is now greater than the actuation pressure of the alarm switch. This means that when the sensor tube is heated, the liquid-gas mixture cannot expand the bellows assembly because it is restrained by the second bellows 23 and their attaching plates 24, 26. The foregoing design works well as long as the bellows assembly 22, 23 is at the same ambient temperature as the sensor tube 10.

Figure 4:
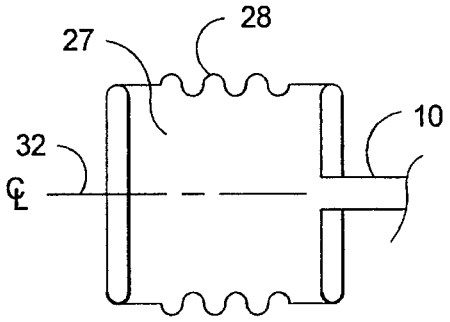
FIG. 4 is a simplified cross-sectional view of an alternative embodiment of a portion of FIG. 1.
Figure 5:
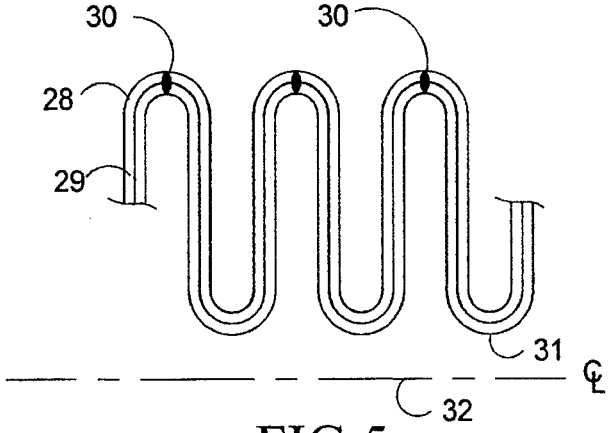
FIG. 5 is an enlarged cross-sectional view of a portion of FIG. 4.

Now referring to the embodiment shown in FIG. 4, a single bellows container 27 with a center line 32 is connected to tube 10 and filled with the same liquid as the tube, and has a flexible wall 28 shown in detail in FIG. 5 which is made from a bimetallic material. As illustrated in FIG. 5, the outer or external side 29 of the bellows is made of a faster expanding metal than the inner wall 31. The two layers of metal 29, 31 are welded at 30. The faster expanding material 29 will thus convolute so that as the bellows is heated, the external metal causes the bellows trapped volume to increase. This volume increase, due to ambient temperature increase, matches exactly to the fluid used. Thus the "spring rate" of this one single bellows would be greater than the pressure required to actuate the alarm switch 12. Therefore the bellows would resist expanding due to a short section of the sensor tube being heated in the presence of an overheat or fire and the fluid pressure would increase to a point where the alarm switch is actuated. Again, this design has the same requirement as the two bellows design in FIG. 1 that the bellows should be at about the same ambient temperature as the sensor tube 10.

The bimetallic design shown in FIG. 5 may be varied in many ways:

1) If the welds 30 are instead placed next to the center line 32 the relative locations of the faster and slower expanding metals, 29 and 31, may be reversed.
2) Only a fragmentary portion of a metal 29 or 31 may be brazed or bonded on the convolutions of a standard bellows with a fragment of faster expanding metal bonded to interior or exterior concave portions of the bellows or a slower expanding metal bonded to similar convex portions.

Figure 7:
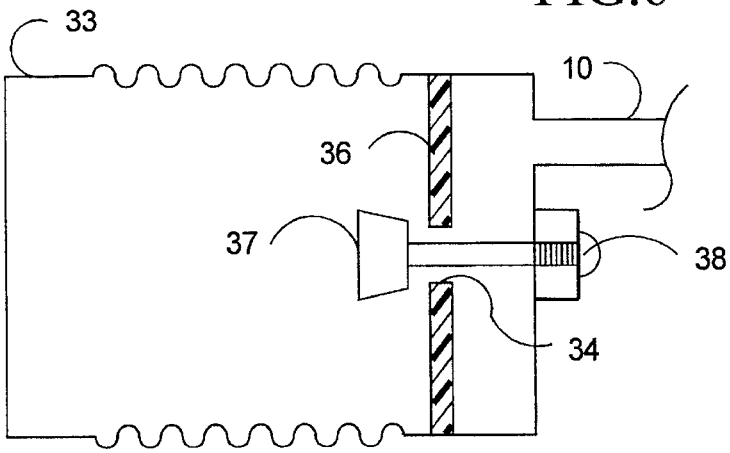
FIG. 7 is a cross-sectional view of an alternative embodiment of FIG. 4.
Figure 8:
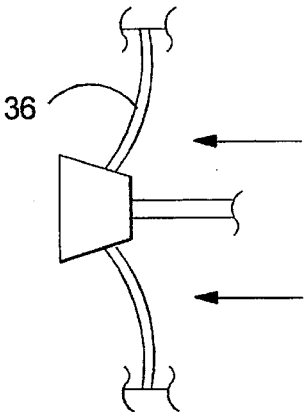
FIG. 8 is a detailed view of a portion of FIG. 7.

In order to allow the accumulator or compensator of the ambient liquid expansion to be at a significantly different temperature than the sensor tube 10 the embodiment of FIG. 7 is provided. Here sensor tube 10 is connected to a bellows 33 which has a spring rate less than the actuation pressure of the alarm switch 12 to allow for liquid expansion due to a rise in ambient temperature. During normal conditions, the temperature rise around the sensor tube is very slow and thus the expansion of the fluid is equally so. The liquid from tube 10 is free to pass through the central aperture 34 in the flexible circular diaphragm 36 which is mounted in the bellows 33. A rubber or tapered metal closing stopper 37 is mounted coaxially with the aperture 34 on the other side of the flow restrictor of the diaphragm 36 (compared to the tube side 10) and may be adjusted by screw type adjuster 38. In operation during an actual fire, as illustrated in FIG. 8, flexible diaphragm 36 because of restriction of the aperture 34, will seal off the aperture due to the increased flow of a liquid going into the vapor phase due to a fire and thus the alarm switch 12 will be actuated.

In construction diaphragm 36 may be of a thin metal such as stainless steel or brass about 5 to 10 mils thick. It can also be made out of a plastic or polymer material such as polyethylene, polypropylene, polyvinyl chloride or a rubber material such as flourosilicone, nitrite polysulfide, or chlorinated polyethylene. The hole diameter 34 depends upon the material thickness, stiffness, the diameter of the diaphragm itself and the viscosity of the sensing fluid. A realistic diameter would range from 0.015 to 0.040 inches. This would allow free flow of the fluid during slow changes of the fluid pressure due to slow ambient temperature changes and enough restriction so that during a fire the diaphragm would deflect and seal against the closing stopper.

Figure 9:
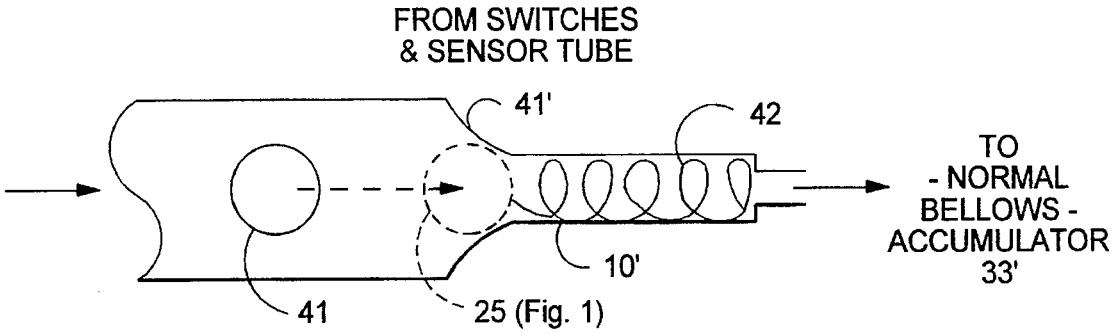
FIG. 9 is a simplified side view of an alternative embodiment of FIG. 7.

FIG. 9 illustrates another embodiment of FIG. 7 where a floating seal ball 41 is used in a tube segment 10' which may be inserted, for example at the location 25 as illustrated in FIG. 1 between switches 12, 21 and sensor tube 10 and a bellows accumulator 33' (without any diaphragm 36 in it). Here liquid flows in the direction indicated tending to push the floating ball 41 against a small spring 42 in a reduced diameter portion of tube 10. When a fire occurs and the velocity of the fluid increases, a sealing occurs as shown in dashed outline as shown at 41' and the alarm switch may be actuated. Ball 41 has the same density as the liquid and can be constructed as, for example, of nylon 12/12.

The diametrical clearance between the floating ball and the tube wall is matched with the viscosity of the sensing fluid and the expected change in pressure which generates the velocity of the fluid.

Although ethylene glycol which has a coefficient expansion of $6.5\times10^{-4}$ has been illustrated, other liquids are suitable (which will resist freezing) such as propylene glycol, silicon, ethylene alcohol, olive oil, etc. Thus an apparatus for detecting a fire or hot gases having a liquid filled sensor tube and compensation for changes in ambient temperature has been provided.

What is claimed is:

1. Apparatus for detecting a fire or hot gases comprising:

a closed elongated sensor tube exposed to a detection zone and completely filled with liquid having a predetermined coefficient of expansion and having a vapor pressure which increases in response to an overheat condition which indicates a presence of a fire or hot gases near the sensor tube;

vapor pressure detection means connected to said sensor tube and the liquid therein and responsive to said increased vapor pressure including a mechanical to electrical transducer means for sensing said vapor pressure, said transducer having a predetermined actuation pressure;

means for compensating for ambient temperature changes which cause expansion or contraction of said liquid in said liquid filled sensor tube, such compensating means including means for distinguishing between normal expansion of said liquid due to increase in ambient temperature and the vapor pressure of said liquid due to sensing a fire, such means in the latter condition allowing for positive actuation of said transducer but in the former condition accommodating the normal increase of volume of said liquid without said actuation; said compensating means including a first enclosed bellows type container which is attached to and in liquid communication with said liquid filled sensor tube and is also filled with said liquid and a second sealed bellows type container which is mechanically coupled in parallel to said first bellows container so as to bias its expansion and contraction and filled again with the same type of fluid as said liquid, such second bellows container having the same characteristic expansion rate as said liquid but with said second bellows container exposed to ambient temperature away from said detection zone, to prevent said first bellows from overexpanding due to said vapor pressure.

2. Apparatus for detecting a fire or hot gases comprising:

a closed elongated sensor tube completely filled with liquid having a predetermined coefficient of expansion and having a vapor pressure which increases in response to an overheat condition which indicates a presence of a fire or hot gases near the sensor tube;

vapor pressure detection means connected to said sensor tube and the liquid therein and responsive to said increased vapor pressure including a mechanical to electrical transducer means for sensing said vapor pressure, said transducer having a predetermined actuation pressure;

means for compensating for ambient temperature changes which cause expansion or contraction of said liquid in said liquid filled sensor tube, such compensating means including means for distinguishing between normal expansion of said liquid due to increase in ambient temperature and the vapor pressure of said liquid due to sensing a fire, such means in the latter condition allowing for positive actuation of said transducer but in the former condition accommodating the normal increase of volume of said liquid without said actuation; said means for compensating including a single bellows type container exposed to ambient temperature away from said detection zone and which is filled with said liquid and includes as at least a portion of the flexible wall of the bellows container a bimetallic material, one of the metals being a faster expanding metal than the other metal, expansion coefficient being chosen to expand the volume of the bellows due to increase in ambient temperature to match exactly to the liquid expansion due to the same increase in ambient temperature, whereby said bellows container will resist expanding if the liquid partially enters the vapor phase in the presence of a fire whereby the alarm transducer is actuated.

3. Apparatus for detecting a fire or hot gases comprising:

a closed elongated sensor tube completely filled with liquid having a predetermined coefficient of expansion and having a vapor pressure which increases in response to an overheat condition which indicates a presence of a fire or hot gases near the sensor tube;

vapor pressure detection means connected to said sensor tube and the liquid therein and responsive to said increased vapor pressure, including a mechanical to electrical transducer means for sensing said vapor pressor, said transducer having a predetermined actuation pressure;

means for compensating for ambient temperature changes which cause expansion or contraction of said liquid in said liquid filled sensor tube, such compensating means including means for distinguishing between normal expansion of said liquid due to increase in ambient temperature and the vapor pressure of said liquid due to sensing a fire or hot gases, such means in the latter condition allowing for positive actuation of said transducer but in the former condition accommodating the normal increase of volume of said liquid without said actuation; said means for compensation including a bellows type container connected to said liquid filled sensor tube and being filled with such liquid and having a spring expansion rate significantly lower than said actuation pressure to normally allow for expansion of said liquid due to increase in ambient temperature but including a flow restrictor which couples said bellows container to said elongated tube, said flow restrictor including means for responding to an increased flow once the liquid begins to go into a vapor phase due to a fire or hot gases which will seal off said bellows container from said elongated sensor tube to stop the flow of said liquid to thereby cause said transducer to be actuated;

wherein said flow restrictor includes a floating seal ball to stop the flow of said liquid when it reaches a certain velocity resulting from liquid expansion due to said fire or gases.

* * * * *